US011749182B2

(12) United States Patent
Wu et al.

(10) Patent No.: US 11,749,182 B2
(45) Date of Patent: Sep. 5, 2023

(54) DISPLAY SYSTEM AND DRIVING DEVICE THEREOF

(71) Applicant: MACROBLOCK, INC., Hsinchu (TW)

(72) Inventors: Ming-Jia Wu, Hsinchu (TW); Che-Wei Chang, Hsinchu (TW); Chi-Min Hsieh, Hsinchu (TW)

(73) Assignee: Macroblock, Inc., Hsinchu (TW)

( * ) Notice: Subject to any disclaimer, the term of this patent is extended or adjusted under 35 U.S.C. 154(b) by 0 days.

(21) Appl. No.: 17/698,651

(22) Filed: Mar. 18, 2022

(65) Prior Publication Data

US 2022/0335885 A1 Oct. 20, 2022

(30) Foreign Application Priority Data

Apr. 16, 2021 (TW) ..... 110113793

(51) Int. Cl.
*G09G 3/32* (2016.01)

(52) U.S. Cl.
CPC ..... *G09G 3/32* (2013.01); *G09G 2310/08* (2013.01)

(58) Field of Classification Search
CPC .... G09G 3/32; G09G 2310/08; G09G 3/2014; G09G 2300/06; G09G 2310/0251; G09G 2320/0223; G09G 2330/021; G09G 2320/0233; G09G 2310/066; G09G 2310/0248
See application file for complete search history.

(56) References Cited

U.S. PATENT DOCUMENTS

| | | | | |
|---|---|---|---|---|
| 10,777,617 | B2 * | 9/2020 | Safaee | G09G 3/32 |
| 2018/0082639 | A1 * | 3/2018 | Shin | G09G 3/3216 |
| 2019/0147795 | A1 * | 5/2019 | Yao | G09G 3/32 345/691 |
| 2019/0340994 | A1 * | 11/2019 | Chen | G09G 3/3688 |
| 2020/0020278 | A1 * | 1/2020 | Lee | G09G 3/3275 |

FOREIGN PATENT DOCUMENTS

| | | |
|---|---|---|
| CN | 105938703 | 9/2016 |
| KR | 10-2012- 0096777 | 8/2012 |
| TW | 200523853 | 7/2005 |
| TW | 1620165 | 4/2018 |

OTHER PUBLICATIONS

Search Report in Taiwanese Appln. No. 110113793, dated Oct. 22, 2021, 2 pages (with English Translation).

* cited by examiner

*Primary Examiner* — Muhammad N Edun
(74) *Attorney, Agent, or Firm* — Akerman LLP; Peter A. Chiabotti

(57) ABSTRACT

A display system includes a light emitting array and a driving device. The light emitting array includes multiple scan lines, multiple drive lines and multiple light emitting elements. The driving device includes a controller, a charge balance line and a charge sharing circuit. The controller generates a control output. The charge sharing circuit is coupled to the drive lines, the charge balance line and the controller, and receives the control output from the controller. With respect to each of the drive lines, the charge sharing circuit is operable, based on the control output, to establish or not establish an electrical connection between the drive line and the charge balance line.

9 Claims, 7 Drawing Sheets

DISPLAY SYSTEM AND DRIVING DEVICE THEREOF

CROSS-REFERENCE TO RELATED APPLICATION

This application claims priority of Taiwanese Patent Application No. 110113793, filed on Apr. 16, 2021.

FIELD

The disclosure relates to display techniques, and more particularly to a display system and a driving device thereof.

BACKGROUND

A light emitting diode (LED) array includes multiple scan lines, multiple drive lines and multiple LEDs, and is driven by a driving device to emit light in a line scan manner. For each line of the line scan of the LED array, if the LEDs in the line are set to have the same expected brightness level, since respective voltages across the LEDs in the line are different before the LEDs in the line become conducting, the LEDs in the line would become conducting at different time points, so respective conduction periods of the LEDs in the line would be different in length, and respective actual brightness levels of the LEDs in the line would be different. When the expected brightness level of the LEDs in the line is low, the aforesaid problem is even more serious since the conduction periods of the LEDs in the line are short in length and length differences among the conduction periods of the LEDs in the line are more noticeable.

SUMMARY

Therefore, an object of the disclosure is to provide a display system and a driving device thereof. The display system can alleviate the drawback of the prior art.

According to an aspect of the disclosure, the display system includes a light emitting array and a driving device. The light emitting array includes a plurality of scan lines, a plurality of drive lines and a plurality of light emitting elements. The light emitting elements are arranged in a matrix that has a plurality of rows respectively corresponding to the scan lines and a plurality of columns respectively corresponding to the drive lines. Each of the light emitting elements has a first terminal and a second terminal. With respect to each of the rows, the first terminals of the light emitting elements in the row are connected to the scan line corresponding to the row. With respect to each of the columns, the second terminals of the light emitting elements in the column are connected to the drive line corresponding to the column. The driving device includes a controller, a charge balance line and a charge sharing circuit. The controller generates a control output. The charge sharing circuit is coupled to the drive lines, the charge balance line and the controller, and receives the control output from the controller. With respect to each of the drive lines, the charge sharing circuit is operable, based on the control output, to establish or not establish an electrical connection between the drive line and the charge balance line.

According to another aspect of the disclosure, the driving device is operatively associated with a light emitting array. The light emitting array includes a plurality of scan lines, a plurality of drive lines and a plurality of light emitting elements. The light emitting elements are arranged in a matrix that has a plurality of rows respectively corresponding to the scan lines and a plurality of columns respectively corresponding to the drive lines. Each of the light emitting elements has a first terminal and a second terminal. With respect to each of the rows, the first terminals of the light emitting elements in the row are connected to the scan line corresponding to the row. With respect to each of the columns, the second terminals of the light emitting elements in the column are connected to the drive line corresponding to the column. The driving device includes a controller, a charge balance line and a charge sharing circuit. The controller generates a control output. The charge sharing circuit is adapted to be coupled to the drive lines, is further coupled to the charge balance line and the controller, and receives the control output from the controller. With respect to each of the drive lines, the charge sharing circuit is operable, based on the control output, to establish or not establish an electrical connection between the drive line and the charge balance line.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
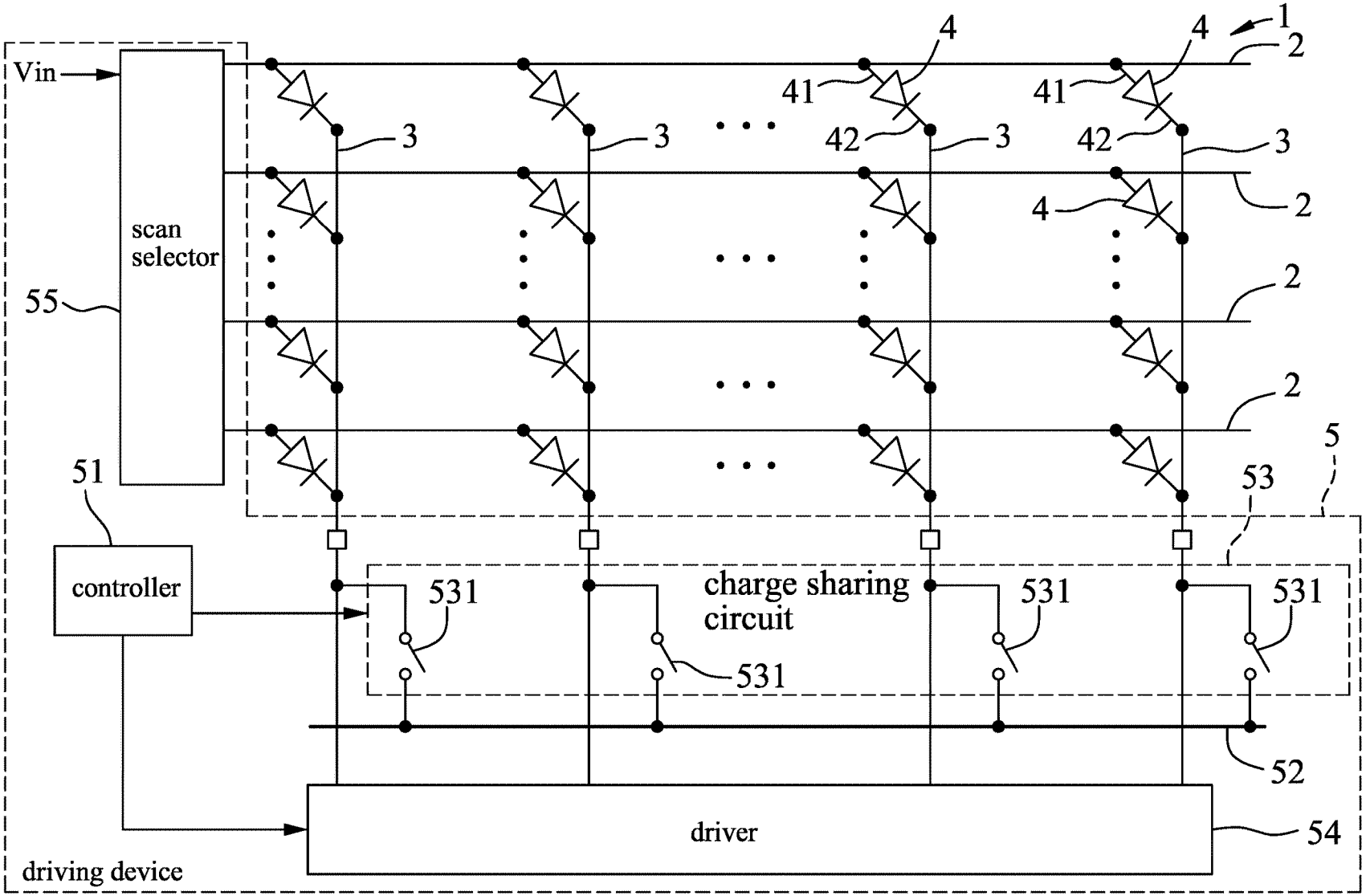
FIG. 1 is a circuit block diagram illustrating an embodiment of a display system according to the disclosure.
Figure 2:
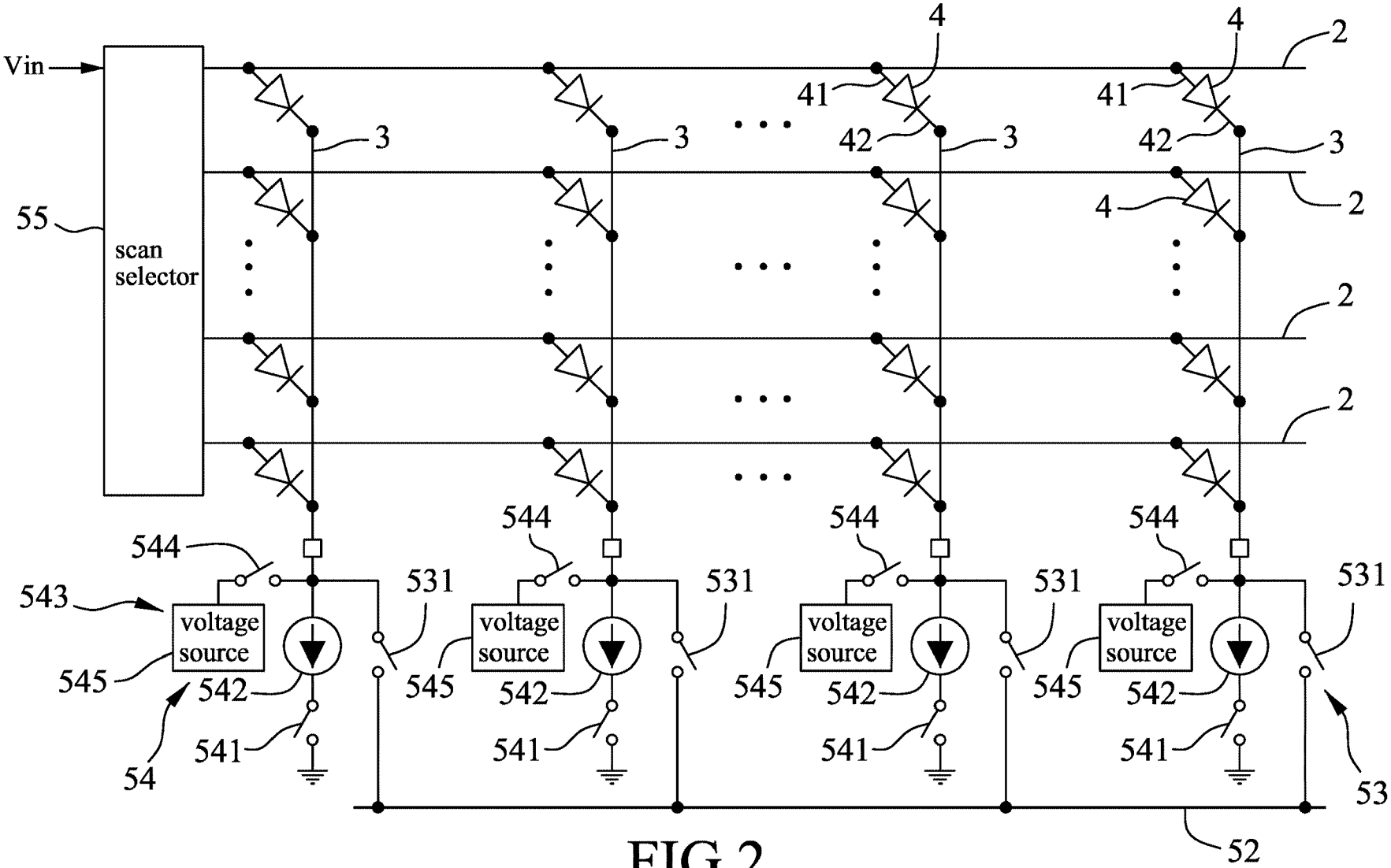
FIG. 2 is a circuit block diagram illustrating a driver of the embodiment.

Referring to FIGS. 1 and 2, an embodiment of a display system according to the disclosure includes a light emitting array 1 and a driving device 5.

The light emitting array 1 includes a plurality of scan lines 2, a plurality of drive lines 3 and a plurality of light emitting elements 4. The light emitting elements 4 are arranged in a matrix that has a plurality of rows respectively corresponding to the scan lines 2 and a plurality of columns respectively corresponding to the drive lines 3. Each of the light emitting elements 4 has a first terminal 41 and a second terminal 42. With respect to each of the rows, the first terminals 41 of the light emitting elements 4 in the row are connected to the scan line 2 corresponding to the row. With respect to each of the columns, the second terminals 42 of the light emitting elements 4 in the column are connected to the drive line 3 corresponding to the column. In this embodiment, each of the light emitting elements 4 is a light emitting diode (LED) having an anode and a cathode that respectively serve as the first terminal 41 and the second terminal 42 of the light emitting element 4.

The driving device 5 includes a controller 51, a charge balance line 52, a charge sharing circuit 53, a driver 54 and a scan selector 55.

The controller 51 generates a control output including at least one control signal, a pulse width modulation output including at least one pulse width modulation signal, and an enable signal.

The charge sharing circuit 53 is coupled to the drive lines 3, the charge balance line 52 and the controller 51, and receives the control output from the controller 51. With respect to each of the drive lines 3, the charge sharing circuit 53 is operable, based on the control output, to establish or not establish an electrical connection between the drive line 3 and the charge balance line 52.

In this embodiment, the charge sharing circuit 53 includes a plurality of balance switches 531 respectively corresponding to the drive lines 3. With respect to each of the drive lines 3, the balance switch 531 corresponding to the drive line 3 is coupled between the drive line 3 and the charge balance line 52, establishes the electrical connection between the drive line 3 and the charge balance line 52 when conducting, and does not establish the electrical connection between the drive line 3 and the charge balance line 52 when not conducting. Switching of the balance switches 531 between conduction and non-conduction is dependent on the control output.

The driver 54 is coupled to the drive lines 3 and the controller 51, and receives the pulse width modulation output and the enable signal from the controller 51. Based on the pulse width modulation output, the driver 54 is operable to provide or not to provide respectively to the drive lines 3 a plurality of drive currents respectively corresponding to the drive lines 3. Based on the enable signal, the driver 54 is operable to provide or not to provide respectively to the drive lines 3 a plurality of bias voltages respectively corresponding to the drive lines 3.

In this embodiment, the driver 54 includes a plurality of drive switches 541 respectively corresponding to the drive lines 3, a plurality of current sources 542 respectively corresponding to the drive lines 3, and a bias circuit 543. With respect to each of the drive lines 3, the corresponding drive switch 541 and the corresponding current source 542 are coupled in series between the drive line 3 and ground, with the corresponding drive switch 541 coupled to ground and the corresponding current source 542 coupled to the drive line 3; when the corresponding drive switch 541 conducts, the corresponding current source 542 provides to the drive line 3 the drive current that corresponds to the drive line 3 and that has a fixed magnitude; and when the corresponding drive switch 541 does not conduct, the corresponding current source 542 does not provide the corresponding drive current to the drive line 3. Switching of the drive switches 541 between conduction and non-conduction is dependent on the pulse width modulation output.

Figure 3:
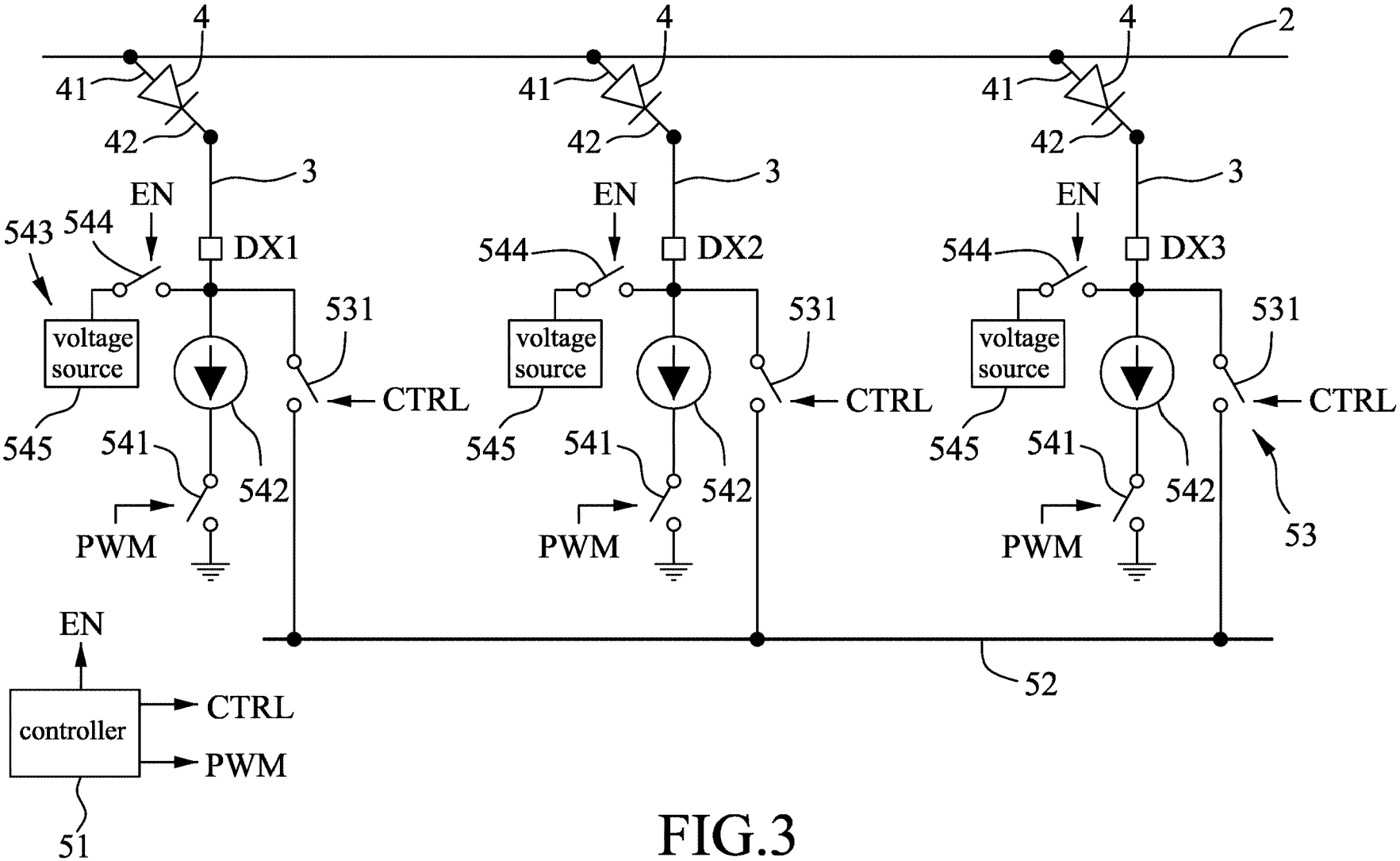
FIG. 3 is a circuit block diagram illustrating a first implementation of the embodiment.

Referring to FIG. 3, the bias circuit 543 is coupled to the drive lines 3 and the controller 51, and receives the enable signal (EN) from the controller 51. Based on the enable signal (EN), the bias circuit 543 is operable to provide or not to provide the bias voltages respectively to the drive lines 3.

In this embodiment, the bias circuit 543 includes a plurality of bias switches 544 respectively corresponding to the drive lines 3, and a plurality of voltage sources 545 respectively corresponding to the drive lines 3. With respect to each of the drive lines 3, the corresponding bias switch 544 is coupled between the drive line 3 and the corresponding voltage source 545, is further coupled to the controller 51 to receive the enable signal (EN), and switches between conduction and non-conduction based on the enable signal (EN); when the bias switch 544 conducts, the voltage source 545 provides the corresponding bias voltage to the drive line 3; and when the bias switch 544 does not conduct, the voltage source 545 does not provide the bias voltage to the drive line 3. Magnitudes of the bias voltages are set to be equal to one of a first voltage level and a second voltage level.

Referring back to FIGS. 1 and 2, the scan selector 55 is coupled to the scan lines 2, is to receive an input voltage (Vin), and outputs the input voltage (Vin) to the scan lines 2 sequentially without overlapping in time so as to drive the light emitting elements 4 to emit light in a line scan manner.

In this embodiment, the first voltage level is sufficient to cause non-conduction of the light emitting elements 4 in the row that corresponds to the scan line 2 supplied with the input voltage (Vin) (hereinafter referred to as the target light emitting elements 4), and is used to eliminate ghost phenomenon of the light emitting array 1. The second voltage level is smaller than the first voltage level, and is sufficient to cause a voltage across each of the target light emitting elements 4 to be smaller than but close to a conduction voltage of the light emitting element 4 in magnitude.

Figure 4:
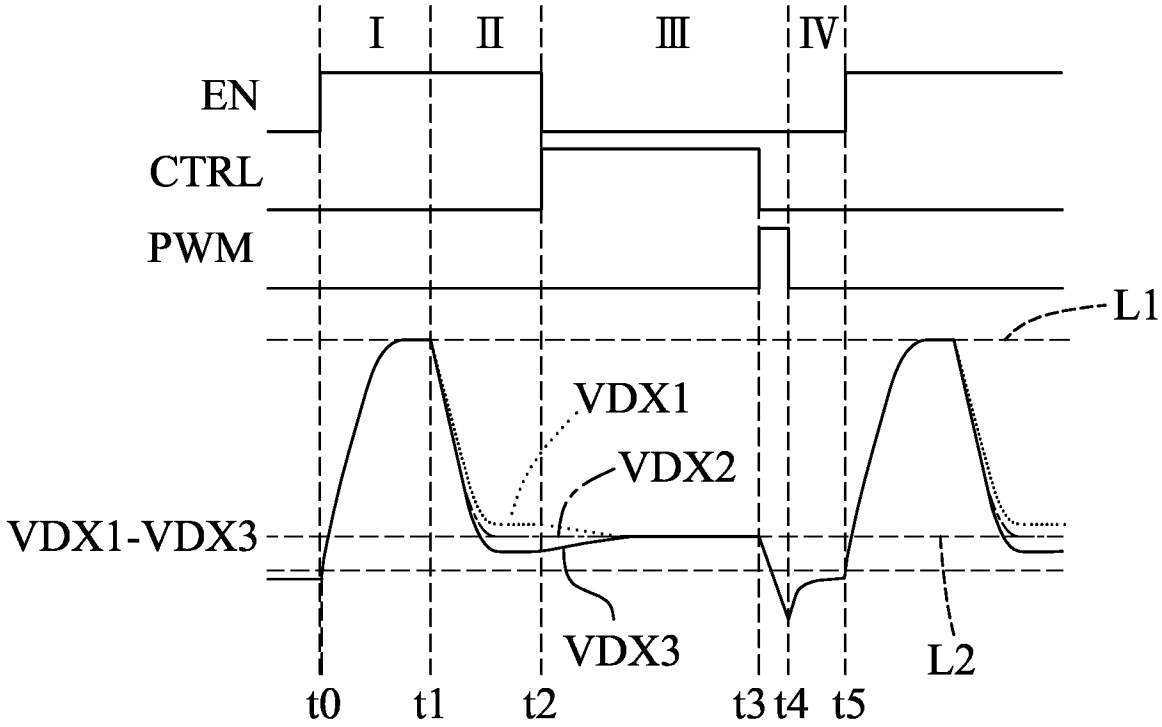
FIG. 4 is a timing diagram illustrating operations of the first implementation.

Referring to FIGS. 3 and 4, FIG. 3 illustrates a first implementation of this embodiment, and FIG. 4 illustrates operations of the first implementation. For convenience of explanation, there are three drive lines 3 in the first implementation, and only one of the scan lines 2 and the corresponding one row of the light emitting elements 4 are depicted in FIG. 3. In the first implementation, the control output includes a control signal (CTRL); the pulse width modulation output includes a pulse width modulation signal (PWM); each of the balance switches 531 is coupled to the controller 51 to receive the control signal (CTRL), and switches between conduction and non-conduction based on the control signal (CTRL); and each of the drive switches 541 is coupled to the controller 51 to receive the pulse width modulation signal (PWM), and switches between conduction and non-conduction based on the pulse width modulation signal (PWM). In other words, the balance switches 531 switch between conduction and non-conduction synchronously, and the drive switches 541 switch between conduction and non-conduction synchronously.

During each line scan cycle of the light emitting elements 4, the driving device 5 sequentially operates in a first phase (I), a second phase (II), a third phase (III) and a fourth phase (IV).

In the first phase (I) from time t0 to time t1, the enable signal (EN) is at an active logic level (e.g., a logic high level) corresponding to conduction of the bias switches 544; the control signal (CTRL) is at an inactive logic level (e.g., a logic low level) corresponding to non-conduction of the balance switches 531; the pulse width modulation signal (PWM) is at an inactive logic level (e.g., a logic low level) corresponding to non-conduction of the drive switches 541; with respect to each of the drive lines 3, the corresponding voltage source 545 provides the corresponding bias voltage to the drive line 3; and the magnitudes of the bias voltages respectively provided by the voltage sources 545 are set to be equal to the first voltage level (L1). Therefore, magnitudes of voltages (VDX1-VDX3) respectively at the drive lines 3 are forced to be equal to the first voltage level (L1), resulting in non-conduction of the target light emitting elements 4.

In the second phase (II) from time t1 to time t2, the enable signal (EN) is at the active logic level (i.e., the logic high level) corresponding to conduction of the bias switches 544; the control signal (CTRL) is at the inactive logic level (i.e., the logic low level) corresponding to non-conduction of the balance switches 531; the pulse width modulation signal (PWM) is at the inactive logic level (i.e., the logic low level) corresponding to non-conduction of the drive switches 541;

with respect to each of the drive lines 3, the corresponding voltage source 545 provides the corresponding bias voltage to the drive line 3; and the magnitudes of the bias voltages respectively provided by the voltage sources 545 are set to be equal to the second voltage level (L2). Therefore, the magnitudes of the voltages (VDX1-VDX3) are forced to be substantially equal to the second voltage level (L2), the target light emitting elements 4 remain non-conducting, and the voltage across each of the target light emitting elements 4 is smaller than but close to the conduction voltage of the target light emitting element 4 in magnitude. It should be noted that the magnitudes of the voltages (VDX1-VDX3) may be different from each other because of non-ideal effects of the light emitting array 1 (see FIG. 1).

As shown in FIG. 4, when the pulse width modulation signal (PWM) has a duty cycle greater than 0% and smaller than 100%, the third phase (III) from time t2 to time t4 is divided into a former portion from time t2 to time t3 and a latter portion from time t3 to time t4. The third phase (III) has a fixed time span, and the latter portion has a time span positively correlated to the duty cycle of the pulse width modulation signal (PWM). In the former portion, the enable signal (EN) is at an inactive logic level (e.g., a logic low level) corresponding to non-conduction of the bias switches 544; the control signal (CTRL) is at an active logic level (e.g., a logic high level) corresponding to conduction of the balance switches 531; the pulse width modulation signal (PWM) is at the inactive logic level (i.e., the logic low level) corresponding to non-conduction of the drive switches 541; and the drive lines 3 are coupled to the charge balance line 52. Therefore, the magnitude differences among the voltages (VDX1-VDX3) gradually decrease because of charge sharing among the drive lines 3. In the latter portion, the enable signal (EN) is at the inactive logic level (i.e., the logic low level) corresponding to non-conduction of the bias switches 544; the control signal (CTRL) is at the inactive logic level (i.e., the logic low level) corresponding to non-conduction of the balance switches 531; the pulse width modulation signal (PWM) is at an active logic level (e.g., a logic high level) corresponding to conduction of the drive switches 541; and with respective to each of the drive lines 3, the corresponding current source 542 provides the corresponding drive current to the drive line 3. Therefore, the magnitudes of the voltages (VDX1-VDX3) drop, and the target light emitting elements 4 become conducting.

It should be noted that the third phase (III) would only have the former portion when the duty cycle of the pulse width modulation signal (PWM) is 0%, and would only have the latter portion when the duty cycle of the pulse width modulation signal (PWM) is 100%.

In the fourth phase (IV) from time t4 to time t5, the enable signal (EN) is at the inactive logic level (i.e., the logic low level) corresponding to non-conduction of the bias switches 544; the control signal (CTRL) is at the inactive logic level (i.e., the logic low level) corresponding to non-conduction of the balance switches 531; and the pulse width modulation signal (PWM) is at the inactive logic level (i.e., the logic low level) corresponding to non-conduction of the drive switches 541.

Figure 5:
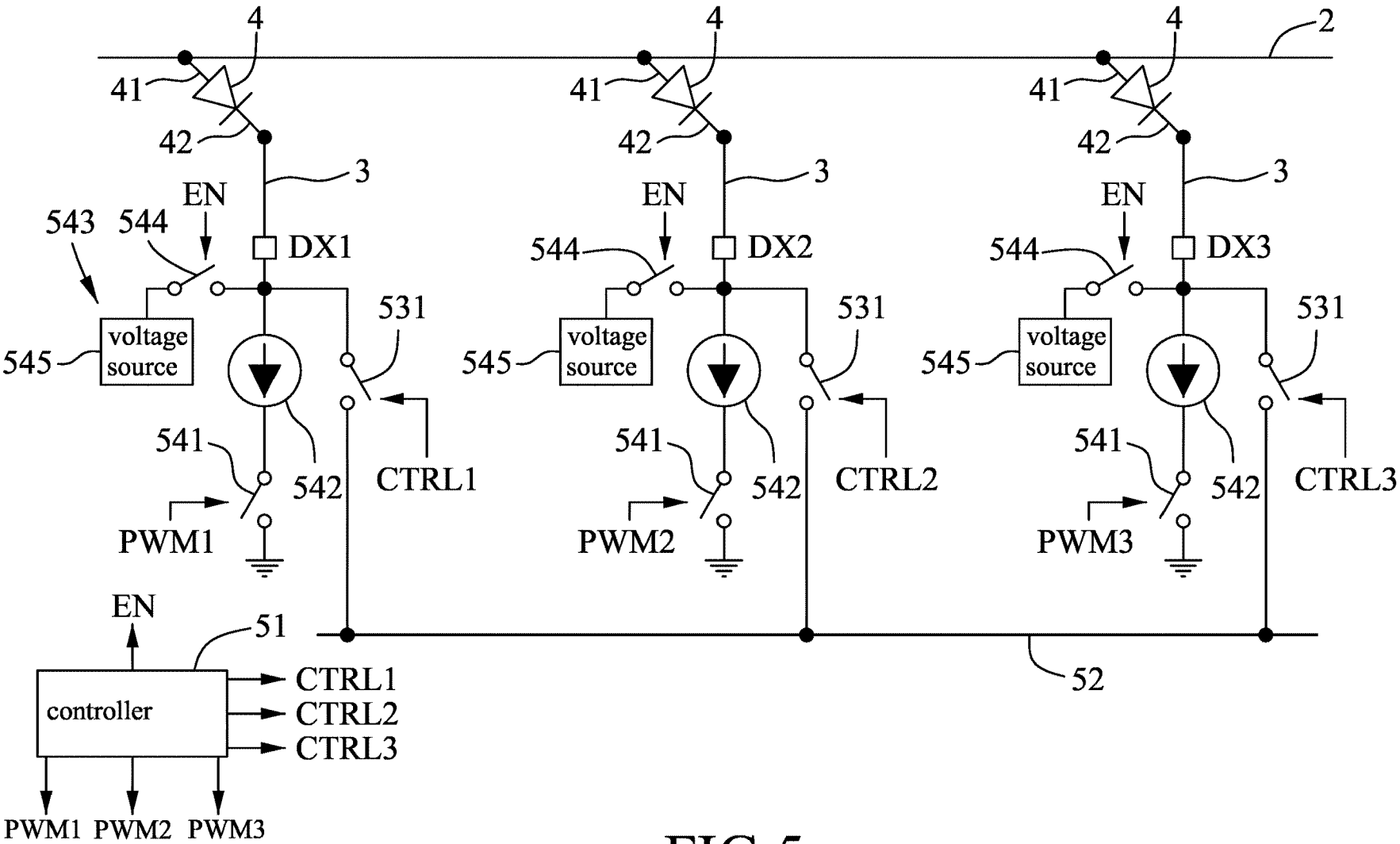
FIG. 5 is a circuit block diagram illustrating a second implementation of the embodiment.
Figure 6:
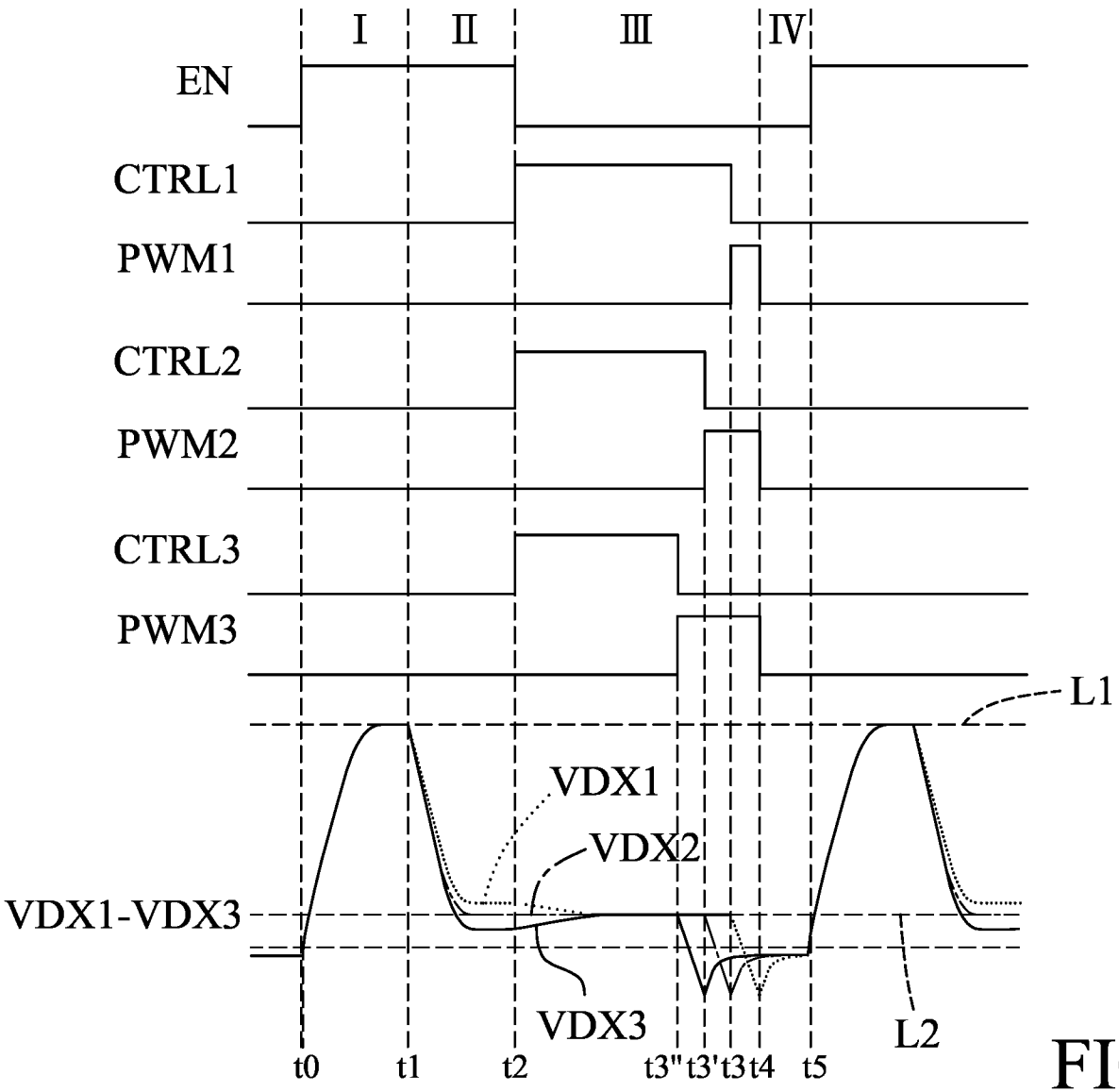
FIGS. 6 and 7 are timing diagrams illustrating operations of the second implementation.
Figure 7:
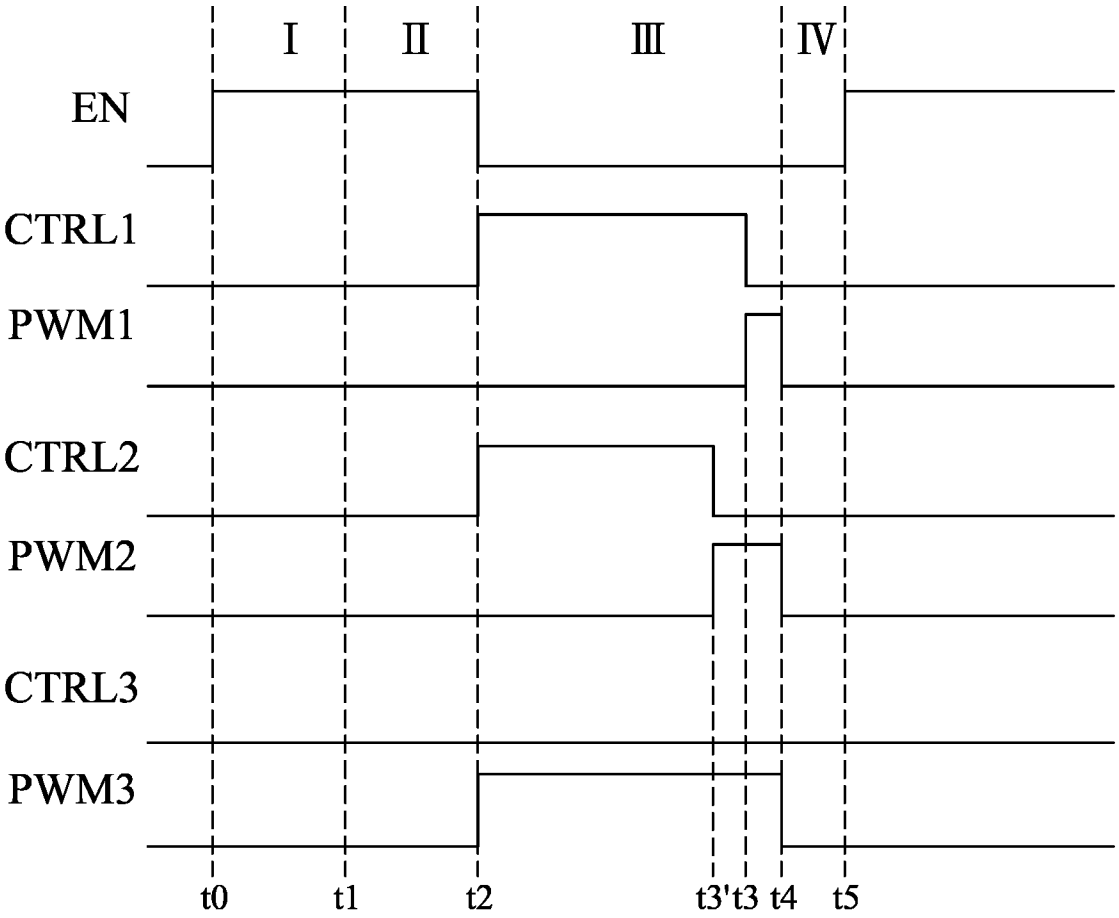

Referring to FIGS. 5 to 7, FIG. 5 illustrates a second implementation of this embodiment, and FIGS. 6 and 7 illustrate operations of the second implementation. For convenience of explanation, there are three drive lines 3 in the second implementation, and only one of the scan lines 2 and the corresponding one row of the light emitting elements 4 are depicted in FIG. 5. In the second implementation, the control output includes a plurality of control signals (e.g., three control signals (CTRL1-CTRL3)) respectively corresponding to the drive lines 3; the pulse width modulation output includes a plurality of pulse width modulation signals (e.g., three pulse width modulation signals (PWM1-PWM3)) respectively corresponding to the drive lines 3; and with respect to each of the drive lines 3, the corresponding balance switch 531 is coupled to the controller 51 to receive the corresponding control signal (CTRL1/CTRL2/CTRL3), and switches between conduction and non-conduction based on the corresponding control signal (CTRL1/CTRL2/CTRL3), and the corresponding drive switch 541 is coupled to the controller 51 to receive the corresponding pulse width modulation signal (PWM1/PWM2/PWM3), and switches between conduction and non-conduction based on the corresponding pulse width modulation signal (PWM1/PWM2/PWM3).

During each line scan cycle of the light emitting elements 4, the driving device 5 sequentially operates in a first phase (I), a second phase (II), a third phase (III) and a fourth phase (IV).

In the first phase (I) from time t0 to time t1, the enable signal (EN) is at an active logic level (e.g., a logic high level) corresponding to conduction of the bias switches 544; each of the control signals (CTRL1-CTRL3) is at an inactive logic level (e.g., a logic low level) corresponding to non-conduction of the corresponding balance switch 531; each of the pulse width modulation signals (PWM1-PWM3) is at an inactive logic level (e.g., a logic low level) corresponding to non-conduction of the corresponding drive switch 541; with respect to each of the drive lines 3, the corresponding voltage source 545 provides the corresponding bias voltage to the drive line 3; and the magnitudes of the bias voltages respectively provided by the voltage sources 545 are set to be equal to the first voltage level (L1). Therefore, magnitudes of voltages (VDX1-VDX3) respectively at the drive lines 3 are forced to be equal to the first voltage level (L1), resulting in non-conduction of the target light emitting elements 4.

In the second phase (II) from time t1 to time t2, the enable signal (EN) is at the active logic level (i.e., the logic high level) corresponding to conduction of the bias switches 544; each of the control signals (CTRL1-CTRL3) is at the inactive logic level (i.e., the logic low level) corresponding to non-conduction of the corresponding balance switch 531; each of the pulse width modulation signals (PWM1-PWM3) is at the inactive logic level (i.e., the logic low level) corresponding to non-conduction of the corresponding drive switch 541; with respect to each of the drive lines 3, the corresponding voltage source 545 provides the corresponding bias voltage to the drive line 3; and the magnitudes of the bias voltages respectively provided by the voltage sources 545 are set to be equal to the second voltage level (L2). Therefore, the magnitudes of the voltages (VDX1-VDX3) are forced to be substantially equal to the second voltage level (L2), the target light emitting elements 4 remain non-conducting, and the voltage across each of the target light emitting elements 4 is smaller than but close to the conduction voltage of the target light emitting element 4 in magnitude. It should be noted that the magnitudes of the voltages (VDX1-VDX3) may be different from each other because of non-ideal effects of the light emitting array 1 (see FIG. 1).

In the third phase (III) from time t2 to time t4, the enable signal (EN) is at an inactive logic level (e.g., a logic low level) corresponding to non-conduction of the bias switches 544. With respect to each of the drive lines 3, when the corresponding pulse width modulation signal (PWM1/

PWM2/PWM3) has a duty cycle greater than 0% and smaller than 100%, the third phase (III) is divided into a former portion from time t2 to time t3/t3'/t3" and a latter portion from time t3/t3'/t3" to time t4. The third phase (III) has a fixed time span, and the latter portion has a time span positively correlated to the duty cycle of the corresponding pulse width modulation signal (PWM1/PWM2/PWM3). In the former portion, the control signal (CTRL1/CTRL2/CTRL3) corresponding to the drive line 3 is at an active logic level (e.g., a logic high level) corresponding to conduction of the corresponding balance switch 531; the pulse width modulation signal (PWM1/PWM2/PWM3) corresponding to the drive line 3 is at the inactive logic level (i.e., the logic low level) corresponding to non-conduction of the corresponding drive switch 541; and the drive line 3 is coupled to the charge balance line 52. In the latter portion, the control signal (CTRL1/CTRL2/CTRL3) corresponding to the drive line 3 is at the inactive logic level (i.e., the logic low level) corresponding to non-conduction of the corresponding balance switch 531; and the pulse width modulation signal (PWM1/PWM2/PWM3) corresponding to the drive line 3 is at an active logic level (e.g., a logic high level) corresponding to conduction of the corresponding drive switch 541; and the current source 542 corresponding to the drive line 3 provides the corresponding drive current to the drive line 3. Therefore, the magnitude of the voltage (VDX1/VDX2/VDX3) at the drive line 3 drops, and the corresponding target light emitting element 4 becomes conducting.

In an example as shown in FIG. 6 where the duty cycle of each of the pulse width modulation signals (PWM1-PWM3) is greater than 0% and smaller than 100%, and where the duty cycle of the pulse width modulation signal (PWM2) is greater than the duty cycle of the pulse width modulation signal (PWM1) and smaller than the duty cycle of the pulse width modulation signal (PWM3), during a period from time t2 to time t3", magnitude differences among the voltages (VDX1-VDX3) gradually decrease because of charge sharing among the drive lines 3, and during a period from time t3" to time t3', the magnitude difference between the voltages (VDX1, VDX2) gradually decreases because of charge sharing between the corresponding drive lines 3. In other words, with respect to each of the drive lines 3, a period for the drive line 3 to participate in the charge sharing roughly increases with decrease of the duty cycle of the corresponding pulse width modulation signal (PWM1/PWM2/PWM3).

It should be noted that, with respect to each of the drive lines 3, the third phase (III) would only have the former portion when the duty cycle of the corresponding pulse width modulation signal (PWM) is 0%, and would only have the latter portion when the duty cycle of the corresponding pulse width modulation signal (PWM) is 100%.

In an example as shown in FIG. 7 where the duty cycle of each of the pulse width modulation signals (PWM1, PWM2) is greater than 0% and smaller than 100%, where the duty cycle of the pulse width modulation signal (PWM2) is greater than the duty cycle of the pulse width modulation signal (PWM1), and where the duty cycle of the pulse width modulation signal (PWM3) is 100%, during a period from time t2 to time t3', the magnitude difference between the voltages (VDX1, VDX2) gradually decreases because of charge sharing between the corresponding drive lines 3, and the magnitude of the voltage (VDX3) remains constant because the corresponding drive line 3 does not participate in the charge sharing.

In the fourth phase (IV) from time t4 to time t5, the enable signal (EN) is at the inactive logic level (i.e., the logic low level) corresponding to non-conduction of the bias switches 544; each of the control signals (CTRL1-CTRL3) is at the inactive logic level (i.e., the logic low level) corresponding to non-conduction of the corresponding balance switch 531; and each of the pulse width modulation signals (PWM1-PWM3) is at the inactive logic level (i.e., the logic low level) corresponding to non-conduction of the corresponding drive switch 541.

Referring back to FIG. 2, in view of the above, in this embodiment, by virtue of the charge sharing circuit 53, and by virtue of making at least two of the balance switches 531 of the charge sharing circuit 53 conduct, charge sharing occurs among the drive lines 3 respectively corresponding to the conducting balance switches 531, and the magnitude difference (s) among the voltages respectively at the drive lines 3 decrease(s), thereby alleviating the drawback of the prior art.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that the disclosure is not limited to the disclosed embodiment but is intended to cover various arrangements included within the spirit and scope of the broadest interpretation so as to encompass all such modifications and equivalent arrangements.

What is claimed is:

1. A display system comprising:

a light emitting array including a plurality of scan lines, a plurality of drive lines, and a plurality of light emitting elements arranged in a matrix that has a plurality of rows respectively corresponding to said scan lines and a plurality of columns respectively corresponding to said drive lines, each of said light emitting elements having a first terminal and a second terminal, with respect to each of said rows, said first terminals of said light emitting elements in said row being connected to said scan line that corresponds to said row, with respect to each of said columns, said second terminals of said light emitting elements in said column being connected to said drive line that corresponds to said column; and a driving device including a driver coupled to said drive lines, to receive a pulse width modulation signal, and operable, based on the pulse width modulation signal, to provide or not to provide respectively to said drive lines a plurality of drive currents respectively corresponding to said drive lines, a controller generating a control output that includes a control signal, a charge balance line, and a charge sharing circuit coupled to said drive lines, said charge balance line and said controller, receiving the control output from said controller, and including a plurality of balance switches that respectively correspond to said drive lines, with respect to each of said drive lines, said charge sharing circuit being operable, based on the control output, to establish or not establish an electrical connection between said drive line and said charge balance line, and said balance switch that corresponds to said drive line being coupled between said drive line and said charge balance line, being further coupled to said controller to receive the control signal, and switching between conduction and non-conduction based on the control signal.

2. The display system of claim 1, wherein:

said driver includes a plurality of drive switches respectively corresponding to said drive lines, and a plurality of current sources respectively corresponding to said drive lines; and with respect to each of said drive lines, said drive switch corresponding to said drive line and said current source corresponding to said drive line are coupled in series between said drive line and ground, said drive switch corresponding to said drive line is to receive the pulse width modulation signal, and switches between conduction and non-conduction based on the pulse width modulation signal, and when said drive switch corresponding to said drive line conducts, said current source corresponding to said drive line provides to said drive line the drive current corresponding to said drive line.

3. The display system of claim 1, wherein said driver further includes:

a bias circuit coupled to said drive lines, to receive an enable signal, and operable, based on the enable signal, to provide or not to provide respectively to said drive lines a plurality of bias voltages respectively corresponding to said drive lines.

4. The display system of claim 3, wherein:

said bias circuit includes a plurality of bias switches respectively corresponding to said drive lines, and a plurality of voltage sources respectively corresponding to said drive lines; and with respect to each of said drive lines, said bias switch corresponding to said drive line is coupled between said drive line and said voltage source corresponding to said drive line, is to receive the enable signal, and switches between conduction and non-conduction based on the enable signal, and when said bias switch corresponding to said drive line conducts, said voltage source corresponding to said drive line provides to said drive line the bias voltage corresponding to said drive line.

5. The display system of claim 1, wherein said driving device further includes:

a scan selector coupled to said scan lines, to receive an input voltage, and outputting the input voltage to said scan lines sequentially without overlapping in time.

6. The display system of claim 1, wherein each of said light emitting elements is a light emitting diode having an anode and a cathode that respectively serve as said first terminal and said second terminal of said light emitting element.

7. A display system comprising:

a light emitting array including a plurality of scan lines, a plurality of drive lines, and a plurality of light emitting elements arranged in a matrix that has a plurality of rows respectively corresponding to said scan lines and a plurality of columns respectively corresponding to said drive lines, each of said light emitting elements having a first terminal and a second terminal, with respect to each of said rows, said first terminals of said light emitting elements in said row being connected to said scan line that corresponds to said row, with respect to each of said columns, said second terminals of said light emitting elements in said column being connected to said drive line that corresponds to said column; and a driving device including a driver coupled to said drive lines, and to receive a plurality of pulse width modulation signals respectively corresponding to said drive lines, with respect to each of said drive lines, said driver being operable, based on the pulse width modulation signal corresponding to said drive line, to provide or not to provide to said drive line a drive current corresponding to said drive line, a controller generating a control output that includes a plurality of control signals respectively corresponding to said drive lines, a charge balance line, and a charge sharing circuit coupled to said drive lines, said charge balance line and said controller, receiving the control output from said controller, and including a plurality of balance switches, with respect to each of said drive lines, said charge sharing circuit being operable, based on the control output, to establish or not establish an electrical connection between said drive line and said charge balance line, and said balance switch that corresponds to said drive line being coupled between said drive line and said charge balance line, being further coupled to said controller to receive the control signal that corresponds to said drive line, and switching between conduction and non-conduction based on the control signal that corresponds to said drive line.

8. The display system of claim 7, wherein:

said driver includes a plurality of drive switches respectively corresponding to said drive lines, and a plurality of current sources respectively corresponding to said drive lines; and with respect to each of said drive lines, said drive switch corresponding to said drive line and said current source corresponding to said drive line are coupled in series between said drive line and ground, said drive switch corresponding to said drive line is to receive the pulse width modulation signal corresponding to said drive line, and switches between conduction and non-conduction based on the pulse width modulation signal corresponding to said drive line, and when said drive switch corresponding to said drive line conducts, said current source corresponding to said drive line provides to said drive line the drive current corresponding to said drive line.

9. A driving device operatively associated with a light emitting array, the light emitting array including a plurality of scan lines, a plurality of drive lines and a plurality of light emitting elements, the light emitting elements being arranged in a matrix that has a plurality of rows respectively corresponding to the scan lines and a plurality of columns respectively corresponding to the drive lines, each of the light emitting elements having a first terminal and a second terminal, wherein with respect to each of the rows, the first terminals of the light emitting elements in the row are connected to the scan line corresponding to the row, and with respect to each of the columns, the second terminals of the light emitting elements in the column are connected to the drive line corresponding to the column, said driving device comprising:

a driver adapted to be coupled to the drive lines, to receive a pulse width modulation signal, and operable, based on the pulse width modulation signal, to provide or not to provide respectively to the drive lines a plurality of drive currents respectively corresponding to the drive lines;

a controller generating a control output that includes a control signal;

a charge balance line; and a charge sharing circuit adapted to be coupled to the drive lines, further coupled to said charge balance line and said controller, receiving the control output from said controller, and including a plurality of balance switches that respectively correspond to the drive lines;

with respect to each of the drive lines, said charge sharing circuit being operable, based on the control output, to establish or not establish an electrical connection between the drive line and said charge balance line, and said balance switch that corresponds to the drive line being coupled between the drive line and said charge balance line, being further coupled to said controller to receive the control signal, and switching between conduction and non-conduction based on the control signal.

* * * * *